United States Patent [19]

Krebs

[11] 4,261,468

[45] Apr. 14, 1981

[54] PILL DISPENSER

[76] Inventor: Helen M. Krebs, 104 Gold Kettle Dr., Gaithersburg, Md. 20760

[21] Appl. No.: 22,678

[22] Filed: Mar. 22, 1979

[51] Int. Cl.[3] ..... B65D 83/04; B65D 85/56

[52] U.S. Cl. ..... 206/538; 221/89; 220/20

[58] Field of Search ..... 116/308-309, 116/319; 206/533-534, 538-539; 220/20; 221/4-5, 89-91

[56] References Cited

U.S. PATENT DOCUMENTS

| | | | |
|---|---|---|---|
| 1,737,643 | 12/1929 | Conner et al. | 206/533 |
| 1,817,562 | 8/1931 | Hodge | 206/538 X |
| 1,896,827 | 2/1933 | Neely | 206/533 X |
| 2,767,680 | 10/1956 | Lermer | 206/534 X |
| 2,903,127 | 9/1959 | Dorman | 206/533 X |
| 3,393,795 | 7/1968 | Covert, Jr. | 206/533 X |
| 3,394,796 | 7/1968 | Jensen | 206/533 |
| 3,561,592 | 2/1971 | McCool | 206/534 |
| 3,921,806 | 11/1975 | Wawracz | 206/533 X |
| 4,083,452 | 4/1978 | Rossmo | 206/533 |

FOREIGN PATENT DOCUMENTS

| | | | |
|---|---|---|---|
| 269942 | 8/1964 | Australia | 206/534 |
| 251562 | 8/1948 | Switzerland | 206/533 |

*Primary Examiner*—Herbert F. Ross
*Attorney, Agent, or Firm*—Henry J. Gens

[57] ABSTRACT

A pill dispenser is provided to enable individuals to take medication at regular specified times throughout the day. The dispenser has an open container with a divider means having a plurality of compartment-forming walls which divide the container into a number of compartments, each compartment adapted to receive and store medication to be taken at a prescribed time as identified with an hour label associated with the compartment, and a rotatable cover enclosing the container and having a sector-shaped opening, which can be moved over a selected compartment for the removal of the medication contained therein. If all compartments are used for holding medication, the sector-shaped opening may be covered with a closure tab which is openable so that the first dose of medication can be taken at the first prescribed time. The divider means may be detachably secured in the container so that it can be replaced with another divider means having a larger or smaller number of compartment-forming walls to thereby accommodate different dosage time periods. The assembly of the dispenser components may be achieved with a separate securing means or the components may be constructed in a particular way without using separate securing means.

1 Claim, 12 Drawing Figures

FIG. 1
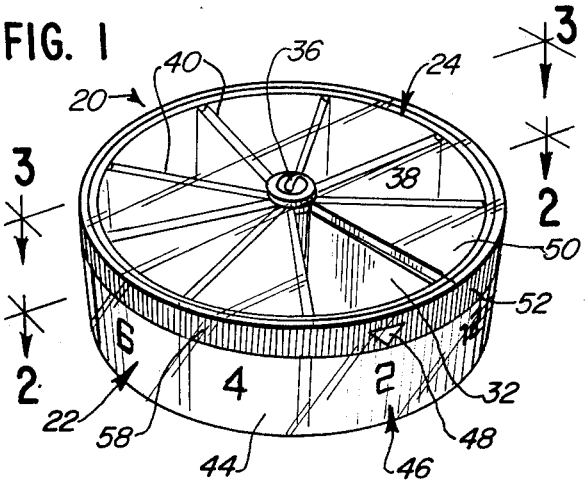
FIG. 2
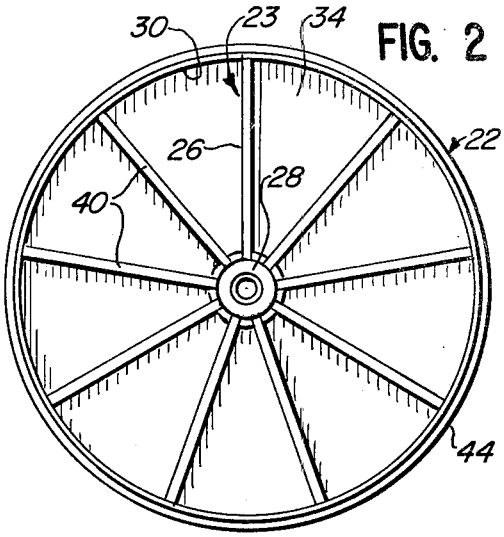
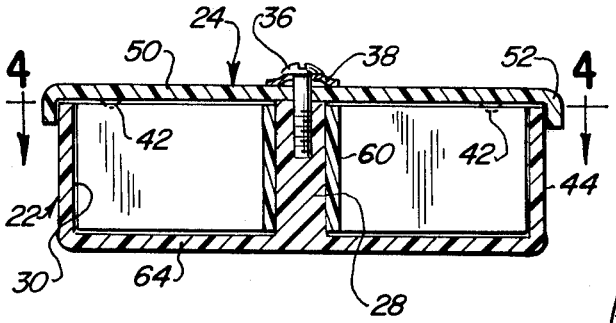
FIG. 4
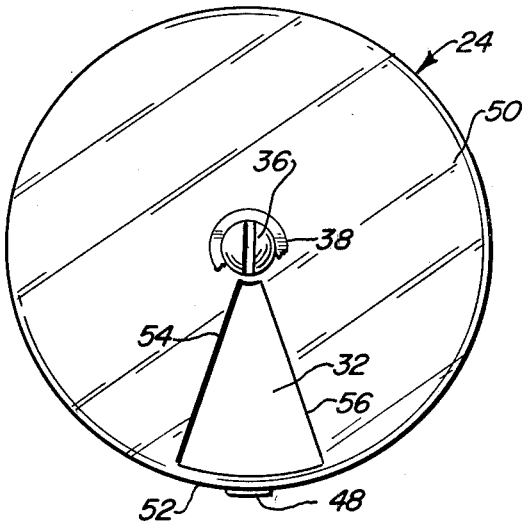
FIG. 3
FIG. 5
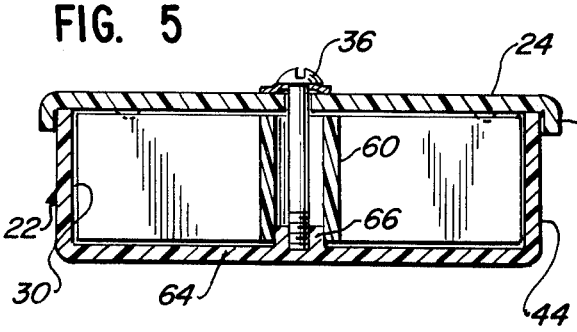
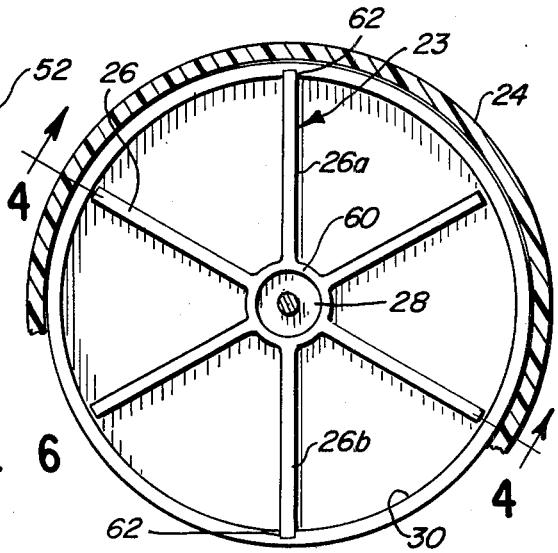
FIG. 6

FIG. 7
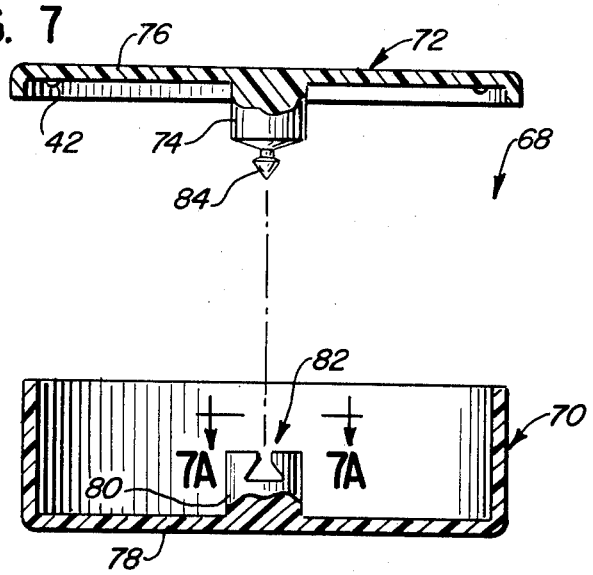
FIG. 7A
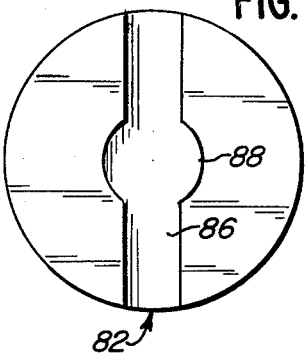
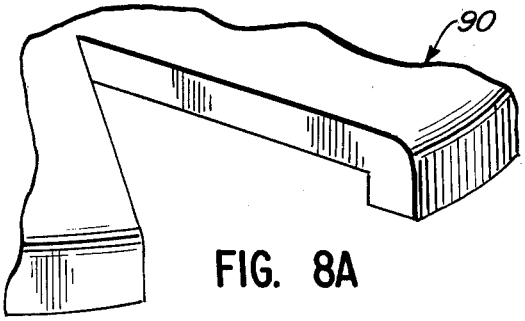
FIG. 8A
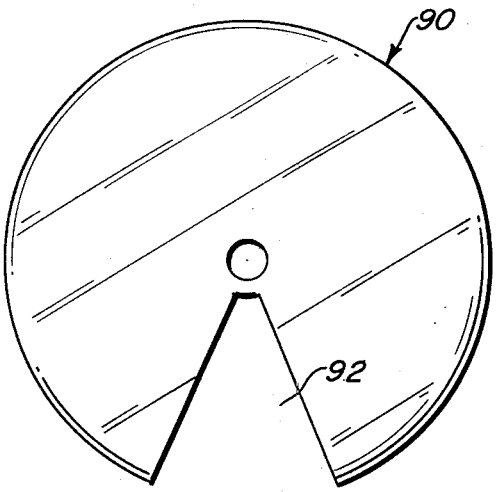
FIG. 8
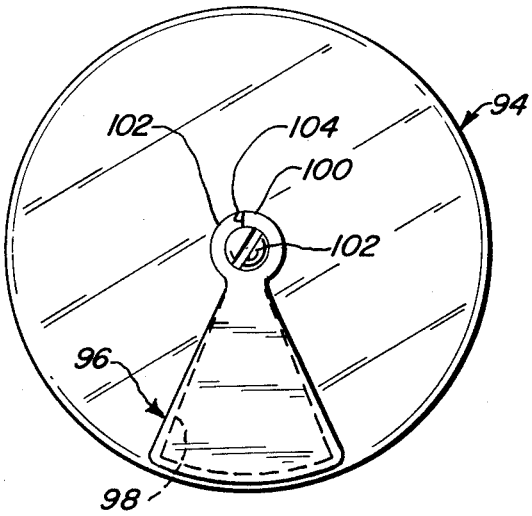
FIG. 9
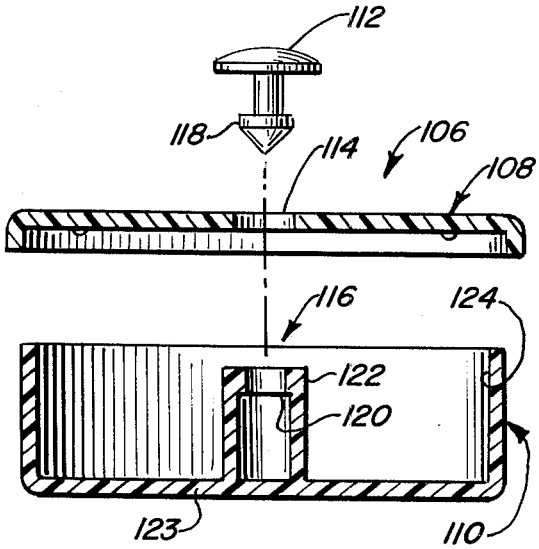
FIG. 10

PILL DISPENSER

BACKGROUND OF INVENTION

This invention relates generally to containers for holding pills, such as pill boxes carried by individuals, and more particularly to a pill dispenser having a plurality of compartments for allocating a number of pills to be dispensed at different hours of the day.

Pill boxes are essentially any containers for holding a supply of pills. Initially, when the pills are purchased at the pharmacy or a drug store, the pills are contained in a large container which cannot be too conveniently carried on the person of an individual. Since only a few pills are required to be taken daily, there is available on the market any number of small pill boxes which are generally decorated to present a pleasing effect. One of the problems associated with taking pills from such pill boxes at prescribed times of the day is that the individual may underdose or overdose, because of memory lapses. For example, if an individual is to take a pill at noon, the individual may not take the pill at that time, thinking that the pill was already taken, whereas it was not. Or the individual, a short time, after noon, may have forgotten that the pill was already taken at noon and mistakenly takes another pill, being under the impression that the pill was not taken at the proper time.

To overcome the foregoing lapses in timing in taking medication, there is presently available a container which was designed to dispense medications over the entire week. In other words, the container possesses 7 compartments associated with the weekdays, each compartment provided with an individual cover which can be opened to remove the pills in a particular compartment associated with a particular day in the week. However, the foregoing does not solve the problem of an individual who has to take a number of pills at prescribed times during a single day.

There is a need for a pill dispenser to be used by people who are required for medical reasons to take medications at regular specified times throughout the day. To attain the most benefit from such medication, it is essential that the medication be taken in a proper dose and at a proper time. For example, a person afflicted with rheumatoid arthritis is required to take an anti-inflammatory drug and an analgesic drug, as many as 48 pills a day, for the reduction of inflammation and alleviation of pain. Persons affected by myasthenia gravis are required to take a specific drug every 3 hours to prevent serious muscle weakness. On the other hand, patients with seizures are required to take medications generally 6 times a day to control their seizures. The Parkinsonian patient medications are titrated as many as 10 times a day to control movement disorders. Kidney and other organ transplant patients are required to take as many as 18 pills a day to meet their medical and post-surgical needs.

There is an urgent need for a device to assist the aged and invalid patients in taking their prescribed medications at particular times. Particularly, there is a need for such a pill dispenser to assist the nurses who provide services through the Home Health Care Plan, wherein the aged and the invalid patients are confined to their homes and are visited by such nurses. During this type of ministration, it is quite helpful for the nurse to arrange the various pills in a pill dispenser and then leave it with the patient for self-treatment until the next daily visit by the nurse to the patient.

SUMMARY OF THE INVENTION

In accordance with the invention, there is provided a device for monitoring the intake of pills by an individual during the course of the day, thereby avoiding uncertainty whether medication has been taken or not.

It is the object of the invention to provide a pill dispenser having a plurality of compartments, each adapted to receive an allocation of pills to be taken at a particular time of the day.

It is a further object of the invention to provide a pill dispenser provided with an interchangeable divider means for dividing the space in the dispenser into any selected numbers of compartments.

Additionally, it is the object of the invention to provide a pill dispenser which can be manufactured easily by molding techniques.

Still, a further object of the invention is to provide a pill dispenser having a container and a cover provided with integrally formed inter-engageable means therebetween to provide for rapid assembly of the dispenser, without the use of independent securing members.

A further object of the invention is to provide a pill dispenser having two portions movable with respect to each other, one portion being provided with an opening which can be moved to register with a particular compartment for releasing therefrom a stored amount of pills.

The pill dispenser comprises an open container, divider means for dividing space in said container into a plurality of uniform compartments, each adapted to receive and hold pills, enclosure means enclosing said container, the enclosure means being provided with an opening to expose one of the compartments, and support means for supporting the enclosure means for movement with respect to the container, whereby the enclosure means can be moved with respect to the compartments to position the opening with respect to a selected compartment to expose the pills contained therein. In practice, the container and the divider means may be integrally molded.

In another embodiment, the dispenser utilizes interchangeable divider means, each of which has a different number of dividing walls which provide a different number of compartments in the container. The container has an integrally formed central column or boss over which a hub of the divider means is positioned.

In both of the foregoing embodiments, the enclosure means is in the form of a cover which is secured to the container by means of a fastener such as a screw.

In further embodiments, the use of a fastener, such as a screw, can be avoided by molding the container, the divider means, and the cover in a particular manner. Integrally formed with the container and the cover is a central stub structure over which the interchangeable divider means is positioned, the ends of the central stub structures having cooperative portions which interlock with each other and thus secure the cover to the container.

The enclosure means which is in the form of a cover has a sector-shaped opening extending from the center of the cover to a rim portion of the cover. A modification of the cover comprises a sector-shaped opening which extends from the center and beyond the periphery of the cover, there being no rim portion.

In a further embodiment, the container and the cover and a locking member are all molded, the cover having a central opening and the container having a central hollow column, the locking member having an intrusion head which is adapted to pass through the opening in the cover and into the hollow column to obtain securement therewith.

Ordinarily, a divider means will be selected having a number of compartment-forming walls which will separate the container into a predetermined number of compartments, not all of the compartments being used for pill storage. For example, a 10 compartment dispenser may be used for allocating medication every three hours on a 12 hour clock basis. This would require only 4 compartments. Thus 6 compartments would not be used and it would not matter that the sector-shaped opening in the cover is not closed. However, in the event that a dispenser has a limited number of compartments, all of which have to be used, the sector-shaped opening can be provided with a closure tab which is pivotally secured to the cover.

DESCRIPTION OF THE DRAWINGS

The invention will now be described in reference to the accompanying drawings, wherein:

FIG. 1 is a perspective view of a pill dispenser comprising a cover, a container and a divider means made of transparent material;

FIG. 2 is a cross-sectional view of the pill dispenser taken along the lines 2—2 of FIG. 1;

FIG. 3 is a plan view of the cover, taken along lines 3—3 as shown in FIG. 1, having a sector-shaped opening through which pills may be dispensed;

FIG. 4 is a cross-sectional view of a second embodiment of the dispenser taken along lines 4—4 of FIG. 6, in which a detachable divider means having a hub is mounted on a column integrally formed with the bottom of the container;

FIG. 5 is a cross-sectional view of a third embodiment of the dispenser using a detachable divider means positioned over a boss integrally formed with the bottom of the container.

FIG. 6 is a partial cross-sectional view taken along the lines 4—4 of the dispenser shown in FIG. 4;

FIG. 7 is a cross-sectional view of a fourth embodiment of the dispenser, in which the cover and the container are provided with stub structures having free ends adapted to intercouple with each other to rotatably secure the cover on the container;

FIG. 7A is an enlarged plan view of the stub structure taken along the lines 7A—7A of FIG. 7;

FIGS. 8 and 8A illustrate a modification of a cover having a sector-shaped opening extending beyond the periphery of the cover;

FIG. 9 is a further modification of a cover provided with a closure tab to close the sector-shaped opening; and FIG. 10 is a cross-sectional view of a fifth embodiment of the dispenser which has molded components which, when assembled, interlock with each other.

DESCRIPTION OF THE PREFERRED EMBODIMENTS

Referring to FIGS. 1, 2, and 3, a pill dispenser 20 comprises a container 22, a divider means 23 within the container, and an enclosure means in the form of a cover 24, the divider means 23 having a plurality of radiating walls 26 extending from a central column 28 to an inner wall 30 of the container 22. The radiating walls 26 and the central column 28 can be integrally molded with the container 22. The cover 24 comprises a circular wall 50 terminating in a rim 52 which is coterminous with an outer wall 44 of the container 22, the cover being provided with a sector-shaped opening 32. The walls 26 divide the interior of the container 22 into a plurality of compartments 34 and the size of the sector-shaped opening 32 corresponds to the size of one of the compartments 34. The cover 24 is rotatably secured to the container 22 by support means, such as a biasing washer 38 and a fastener 36 anchored in the central column 28 and urging the cover toward the container.

As shown in FIG. 1, upper edges 40 of the walls 26 possess concave depressions which are adapted to receive one or more nibs 42 molded in the undersurface of the cover 24, for example as shown in FIG. 4. The nibs 42 and the concave edges 40 provide interengagement means, whereby the cover 24 will interlock with respect to the container 22 so that the opening 32 may register with any one of the compartments 34.

The outer wall 44 of the container 22 is provided with indicia 46 numerically identifying the various compartments 34. The indicia may be molded in the surface of the outer wall 44 or may be applied by printing or by adhesive labels. The cover 24 may be provided with an indicator number 48 which is adapted to register with the indicia 46 whenever the opening 32 is positioned over a particular compartment. The biasing washer 38 provides sufficient resiliency between the cover 24 and the container 22 to facilitate a disengagement between the nibs 42 and the concave upper edges 40 on top of the walls 26.

As shown, the dispenser 20 has nine compartments 34, eight of the compartments are completely closed and can be filled with pills, the unused compartment being the one in registration with the opening 32 in the cover 24. As an example, with the eight compartments, on the basis of a 24 hour medication period, each of the compartments would be associated with a three-hour dispensing interval. Of course, it is clear that not all of the compartments will be filled with medication if the medication dispensing period is longer. For example, if a patient is required to take medication every three hours in a 12-hour medication period, four compartments would be used, each used compartment being filled with the necessary medication and associated with a three-hour dispensing interval. As shown in FIG. 1, the rim 52 is provided with knurls 58 to provide the user with a firm grasp of the cover 24 whenever it is necessary to rotate it into registry with the next succeeding compartment for pill dispensing.

Since the desired number of compartments in the dispenser will vary with the needs of one patient to another, the divider means 23 may be separately molded so that it can be detachably secured within the container 22. Such modification is shown in the embodiments illustrated in FIGS. 4–6. The divider means 23 is formed in the shape of a paddle wheel having a number of walls 26 radiating outwardly from a hub 60 which is placed over the central column 28. In order to prevent the divider means 23 from rotating about the column 28, walls **26*a* and 26*b* are a trifle longer than the other walls so that they engage with slots 62 in the inner wall 30 of the container. The column 28 is integrally molded with a bottom wall 64 of the container 22**.

The modification shown in FIG. 5 is essentially the same as that shown in FIG. 4, except that the central column is short, in the form of a boss 66 integrally molded with the bottom wall 64, the boss 66 functioning to position the hub 60 of the divider means 23, in the same manner as the column 28 functions in the modification shown in FIG. 4.

The embodiments shown in FIGS. 4–6 differ from that shown in FIG. 1 in that the cover 24 has a rim 52 which extends beyond the outer wall 44 of the container 22. It should be noted that the column 28 and the hub 60 shown in FIG. 4 and the hub shown in FIG. 5 possess a height which is less than the height of the inner wall 30 inside the container 22, a clearance exists below the central portion of the cover 24 so that the cover may be deflected or biased toward the container 22 to attain proper engagement and disengagement between the nibs 42 and the upper concave edges 40 of the walls 26.

Referring to FIGS. 7 and 7A, there is shown a simplified construction (divider means not shown) of a pill dispenser which does not use any additional components to provide a complete assembly. In other words, the components of the dispenser are assembled together without using the screw 36 and the biasing member 38. A dispenser 68 comprises a container 70 and an enclosure means in the form of a cover 72. The cover 72 is provided on its underside with a stub 74 integrally molded and extending from a circular wall 76. Similarly, the container 70 has a bottom wall 78 with an integrally formed stub 80 which, at its free end, is provided with a holding cavity 82 which is adapted to receive a projecting member 84 extending from the free end of the stub 74. As shown in the enlarged view of FIG. 7A, the holding cavity 82 comprises a slot 86 having a centrally located enlarged opening 88 to admit the projecting member 84.

The container 70 may be molded from any plastic material. The cover 72 is similarly molded from a plastic material except that the material must be yieldable so that during assembly, as the cover 72 is placed over the container 70 and then the cover is pressed in its central portion, the projecting member will enter into the holding cavity 82 and engage therewith. Upon release of pressure from the central portion of the cover 72, the central portion of the cover will move upwardly a minimal distance so that the central portion of the cover 72 will present a slightly concave depression. The resiliency developed between the engaged portions of the cover and the container is sufficient so that the hubs 42 are in engagement with the concave upper edges 40 of the walls 26, for example as shown in FIG. 4. The embodiment shown in FIGS. 7 and 7A may be used with a detachable divider means (not shown) having a hub which would be engageable with the stubs 74 and 80 and secured in the container 70 by slots, for example such as slots 62 shown in FIG. 6.

FIGS. 8 and 8A show a modified cover 90 provided with a sector-shaped opening 92 which is completely opened at its radial perimeter, as opposed to the opening 32 shown in FIG. 3, wherein the rim 52 peripherally closes the opening 32.

A further modification of a cover is shown in FIG. 9, wherein a cover 94, identical to the cover 24 in FIG. 3, is provided with a closure tab 96 having a sector shape and extending from a pivot portion 100 centrally secured to the cover 94 by fastener 102. The closure tab 96 is made from metal and has a split portion 104 in the pivot portion 100. The split portion 104 performs two functions, biasing and anchoring. The split portion 104 acts as a spring washer and resiliently biases the cover 94 against the container. Further, a sharp edge on the split portion 104 anchors the closure tab 96 on the cover 94 so that it rotates with the cover as it is moved over a selected compartment. However, the split portion 104 will permit rotational movement of the closure tab 96 with respect to the cover 94 to thereby uncover a sector-shaped opening 98 in the cover to enable the user to gain access to the selected compartment. The size of the sector-shaped closure tab 96 is slightly larger than opening 98 indicated by broken outline.

A still further embodiment of the pill dispenser is shown in FIG. 10 wherein a dispenser 106 comprises a cover 108, a container 110 and a lock pin 112, all of which are molded from plastic material. A divider means, not shown in the cross-sectional view, can be integrally molded with the container 110. The pill dispenser 106 is assembled by positioning the cover 108 atop the container 110 and then inserting the lock pin 112 through an opening 114 in the cover and forcing the lock pin into a holding cavity 116 in a column 122 so that a head 118 on the lock pin 112 engages with a lock surface 120 within the column 122 integrally molded with the bottom wall 123 of the container 110. The cover 108 should be made from a plastic material that will yield when pressed in the center portion thereof in the direction of the column 122. The height of the column 122 is less than the height of an inner wall 124 on the inside of the container 110 to provide a sufficient clearance for the lock pin 112 to enter into the holding cavity 116 and interengage the head 118 with the column 122. Of course, the divider means could be made detachable by providing it with a hub adapted to slip over the column 122, similar to the embodiment shown in FIG. 4, 5 or 6.

Although the components of the pill dispenser can be molded from any type of plastic material, it is preferred that the cover be made of a clear plastic material to disclose the contents in the container and which is also yieldable to pressure applied in the central portion of the cover to provide proper interaction between the nibs 42 and the concave upper edges 40 of the divider means 23.

A typical model of the pill dispenser that was constructed was about 3¼ inches in diameter, with the container being 1 inch high and a cover having a depth of ¼ inch.

Typically, for example, the embodiment shown in FIG. 10 is manufactured by an injection molding process. The components of the pill dispenser 106 are manufactured in three molds, one producing the cover 108, one the container 110, and one for the lock pin 112, which holds the container and the cover together. The cover and the container are made from clear polystyrene and the lock pin is made from clear polyethylene.

In connection with the description pertaining to the embodiments using detachable divider means, the size of the sector-shaped opening has to be designed for use with the divider means having the larger plurality of compartment-forming walls. Assuming that it is desired to manufacture a pill dispenser provided with detachable divider means, if the diameter of the container is 3.25 inches, the circumference of the container is approximately 10.2 inches. Assuming that a pair of divider means are to be used with the container, one divider means having six compartment-forming walls and the other divider means having 12 compartment-forming walls, the size of the sector-shaped opening would be designed to have an arcuate periphery of approximately 0.85 inches which was obtained by dividing the circumference of 10.2 inches by 12. The opening having the arcuate periphery of 0.85 inches would serve satisfactorily to release pills contained in a particular compartment either in a six compartment or twelve compartment arrangement. In other words, in using any number of detachable divider means, the size of the opening in the cover would be determined by the size of compartment in the divider means having the most compartment walls.

While there have been described what is at present considered to be the preferred embodiments of the invention, it will be understood that various modifications may be made therein, and it is intended to cover in the appended claims all such modifications as fall within the true spirit and scope of the invention.

What is claimed is:

1. A pill dispenser comprising an open container having a circular wall, divider means for dividing the space in said container into a plurality of uniform compartments, each adapted to receive and hold pills, enclosure means enclosing said container, said enclosure means being provided with an opening to expose one of said compartments, and support means for supporting said enclosure means for movement with respect to said container, said support means comprising an integrally molded central column having a holding member and extending out of the bottom of said container, the height of said column being less than the height of said circular wall, and means associated with said enclosure means for depressing the central portion of said enclosure means and interlocking with said holding member in said column, said enclosure means comprising a round cover centrally coupled to said central column, said divider means comprising a plurality of walls radiating outwardly from said central coulumn, including interengagement means on said container and on said cover for cooperatively providing interlocking between said container and said cover, said interengagement means comprising at least one nib integrally formed with the undersurface of said cover, and said radiating walls having concavely formed upper edges, whereby interengagement between the cover and the container is obtained when said nib engages with the concavity of any one of said edges, and whereby the depressed area of said enclosure means provides resilient rotatable interengagement between said enclosure means and said container.

* * * * *